US011225736B2

(12) United States Patent
Lonati et al.

(10) Patent No.: US 11,225,736 B2
(45) Date of Patent: Jan. 18, 2022

(54) CIRCULAR KNITTING MACHINE AND A METHOD FOR MOVING THE NEEDLES OF A CIRCULAR KNITTING MACHINE

(71) Applicant: SANTONI S.P.A., Brescia (IT)

(72) Inventors: Andrea Lonati, Brescia (IT); Mauro Alghisi, Brescia (IT); Maurizio Lodrini, Brescia (IT)

(73) Assignee: SANTONI S.P.A., Brescia (IT)

( * ) Notice: Subject to any disclaimer, the term of this patent is extended or adjusted under 35 U.S.C. 154(b) by 109 days.

(21) Appl. No.: 16/607,987

(22) PCT Filed: Mar. 27, 2018

(86) PCT No.: PCT/IB2018/052072
§ 371 (c)(1),
(2) Date: Oct. 24, 2019

(87) PCT Pub. No.: WO2018/197970
PCT Pub. Date: Nov. 1, 2018

(65) Prior Publication Data

US 2021/0108344 A1 Apr. 15, 2021

(30) Foreign Application Priority Data

Apr. 24, 2017 (IT) ..... 102017000044701

(51) Int. Cl.
*D04B 9/36* (2006.01)
*D04B 9/38* (2006.01)
(Continued)

(52) U.S. Cl.
CPC ..... *D04B 9/36* (2013.01); *D04B 9/38* (2013.01); *D04B 15/14* (2013.01); *D04B 15/322* (2013.01); *D04B 15/68* (2013.01)

(58) Field of Classification Search
CPC ... D04B 9/06; D04B 9/20; D04B 9/36; D04B 9/38; D04B 9/56; D04B 15/14; D04B 15/322; D04B 15/32; D04B 15/68
See application file for complete search history.

(56) References Cited

U.S. PATENT DOCUMENTS 3,097,510 A * 7/1963 Brown ..... D04B 15/68 66/49
3,181,940 A * 5/1965 Tenconi ..... D04B 9/46 66/49

(Continued)

FOREIGN PATENT DOCUMENTS

EP 0 074 931 A1 3/1983
WO 2004/097092 A1 11/2004

OTHER PUBLICATIONS

May 18, 2018 International Search Report issued in International Patent Application No. PCT/IB2018/052072.

(Continued)

*Primary Examiner* — Danny Worrell
*Assistant Examiner* — Aiying Zhao
(74) *Attorney, Agent, or Firm* — MH2 Technology Law Group LLP

(57) ABSTRACT

A circular knitting machine includes a needle-holding cylinder having plurality of longitudinal grooves arranged around central axis, and plurality of needles, each being housed in longitudinal groove. Drive chain for each needle is inserted into each groove and operatively placed between needle and actuating cams. Drive chain includes sub-needle slidingly arranged in groove and having a butt. Butt is radially movable between operating position, extracted to engage with respective first paths and cause activation of needle and stitch formation, and non-operating position, retracted so as not to engage with first paths. A selector is arranged under sub-needle, and punch is arranged between (Continued)

sub-needle and selector. An activating element is slidingly arranged in groove between sub-needle and selector, can be longitudinally moved with respect to punch and sub-needle, and can be operatively engaged with sub-needle to switch butt of sub-needle into and retain it in operating position.

21 Claims, 11 Drawing Sheets

(51) Int. Cl.

| | |
|---|---|
| ***D04B 15/14*** | (2006.01) |
| ***D04B 15/32*** | (2006.01) |
| ***D04B 15/68*** | (2006.01) |

(56) References Cited

U.S. PATENT DOCUMENTS 4,709,563 A * 12/1987 Camiciotti ..... D04B 15/82 66/222
5,072,603 A * 12/1991 Tenconi ..... D04B 15/68 66/222
5,960,645 A * 10/1999 Sangiacomo ..... D04B 15/68 66/13
6,101,850 A * 8/2000 Ma Dalmau Guell ..... D04B 15/68 66/221
6,257,026 B1 * 7/2001 Ando' ..... D04B 15/68 66/221
7,207,196 B2 * 4/2007 Lonati ..... D04B 9/38 66/222
7,739,889 B2 * 6/2010 Lonati ..... D04B 15/325 66/220
7,765,834 B2 * 8/2010 Ando ..... D04B 15/325 66/14
8,561,434 B2 * 10/2013 Busi ..... D04B 15/32 66/40

OTHER PUBLICATIONS

May 18, 2018 Written Opinion of the International Searching Authority issued in International Patent Application No. PCT/IB2018/052072.

* cited by examiner

CIRCULAR KNITTING MACHINE AND A METHOD FOR MOVING THE NEEDLES OF A CIRCULAR KNITTING MACHINE

FIELD OF THE INVENTION

The present invention relates to a circular knitting machine and to a method for moving the needles of a circular knitting machine. In particular, the present invention relates to the moving mechanisms for the needles. More particularly, the present invention relates to the structure of the elements actuating the needles by turning the relative rotating movement between the needle-holding element and the actuating cams into given axial movements of the needles.

BACKGROUND OF THE INVENTION

As is known, circular knitting machines comprise a needle-holding element (needle cylinder and/or plate) on which one or more series of needles are arranged along a circular path (circular needlebeds), and devices apt to control the movement of the needles for knitted fabric formation. The devices for controlling the needles of the needle-holding cylinder comprise actuating cams arranged around the cylinder itself, and actuating means configured for operatively connecting the cams to the needles. These actuating means, also defined as "flat parts", are inserted into the grooves of the needles, below the latter, and have butts configured for cooperating with said cams.

It is known about actuating means comprising a butt, part of the needle or of an element directly connected thereto (sub-needle), of a radially moving type, which allows to disengage the needle from the cams at least for a length of the circular path so that the needle does not move axially forming the stitch (inactive needle).

For instance, public documents EP 1 620 590 and EP 1 620 591, issued to the same Applicant, disclose both a circular knitting machine equipped with a cylinder provided with axial grooves. Each needle of a plurality of needles is housed in one of said axial grooves and actuating means, also placed in the axial grooves, interact with the needles during the rotation of the cylinder so as to cause the actuation thereof. The actuating means of each needle comprise: a sub-needle connected to the respective needle, which can be radially oscillated in the groove so as to selectively engage its own butt with paths defined by actuating cams, a punch having an upper portion which can be engaged with a lower end of the sub-needle, which can also be engaged with respective paths defined by the actuating cams, a selector which can be oscillated in a radial plane, so as to engage into respective paths defined by the actuating cams, and which can be activated by means of selecting devices, wherein the selector has an upper portion which can be engaged against a lower portion of the punch. As can be observed, the punch of EP 1 620 590 and EP 1 620 591 pushes against the sub-needle and performs the further function of determining the radial oscillation of the sub-needle and the subsequent radial movement of the butt of said sub-needle. The punch acts directly upon the sub-needle and is forced to follow the axial movement of the respective needle. The axial movement of the needle and sub-needle is thus bound to the axial movement of the punch and selector.

SUMMARY

In the framework of circular knitting machines as the ones disclosed above, the Applicant has identified the presence of some drawbacks.

First of all, the Applicant has noted that known machines as described above have large axial and circumferential sizes and these known machines cannot be manufactured with diameters below predefined diameters, since doing so it is not possible to provide known actuating means for the needles with such characteristics as to allow all the movements required for knitting.

The Applicant has further noted that in known solutions, in particular in the case of knitting machines with needle-holding cylinder having a small diameter—e.g. below 10 inches (about 250 mm)—it is not possible to introduce a large number of feeds (e.g. above four) since there is not enough room around the cylinder for housing all necessary actuating means.

The sizes of known machines have a negative impact upon the inertias at stake, which limit the rotational speed and therefore the knitting speed.

The Applicant has further noted that known machines as described above have a limited number of possible movements of the needles, which limits production flexibility.

In particular, the Applicant has noted that in known machines the radial movement of the butt of the needle or sub-needle, which allows to disengage the needle from the cams (inactive needle), basically always depends on the axial movements of the selector and/or punch and this characteristic limits the movements to be assigned to the needles.

Under these circumstances, an aim underlying the present invention, in its various aspects and/or embodiments, is to propose a circular knitting machine which, the knitting characteristics to be achieved being the same, or even with more knitting characteristics to be achieved with respect to the prior art, has a small size and allows to manufacture fabrics with relatively small diameters, e.g. below 165 mm.

A further aim of the present invention is to propose a circular knitting machine and a method for moving the needles which allow to increase the plurality of movements which can be assigned to the needles so as to achieve a higher production flexibility, i.e. so as to manufacture different types of fabrics with several characteristics differing one from the other.

A further aim of the present invention is to propose a circular knitting machine and a method for moving the needles which allow to increase the number of yarn feeding points, or feeds, to be defined, the diameter of the needle-holding element being the same, with respect to the prior art.

A further aim of the present invention is to provide a circular knitting machine characterized by a simple and rational structure.

A further aim of the present invention is to create alternative solutions to the prior art for carrying out circular knitting machines, and/or to open new design possibilities.

These and other possible aims, which shall appear better from the following description, are basically achieved by a circular knitting machine and by a method for moving the needles, according to one or more of the appended claims and according to the following aspects and/or embodiments, variously combined, possibly also with the aforesaid claims.

In the present description and in the appended claims, the words "upper", "lower", "above" and "below" relate to the positioning of the machine during normal operation with the central axis of rotation in vertical position and the cylinder needles pointing upwards.

In the present description and in the appended claims, the words "axial", "circumferential", "radial" relate to said central axis.

Some aspects of the invention are listed below.

In one aspect, the invention relates to a circular knitting machine comprising: a basement; a needle-holding cylinder mounted onto the basement and having a plurality of longitudinal grooves arranged around a central axis of the needle-holding cylinder; a plurality of needles, each being housed in a respective longitudinal groove; actuating cams arranged around the needle-holding cylinder and movable with respect to said needle-holding cylinder around the central axis for causing or allowing the movement of the needles along the longitudinal grooves so as to enable stitch formation by said needles; a drive chain for each needle inserted into the respective longitudinal groove, located below the respective needle and operatively placed between the respective needle and said actuating cams.

In one aspect, said drive chain comprises: a sub-needle slidingly arranged in the respective longitudinal groove below the needle and having a butt, wherein the butt is radially movable between an operating position, in which it is extracted so as to engage with respective first paths defined by first actuating cams and cause the activation of the needle and the stitch formation, and a non-operating position, in which it is retracted so as not to engage with said first paths.

In one aspect, said drive chain comprises: a selector at least partly slidingly arranged in the respective longitudinal groove below the sub-needle, having at least one respective butt radially movable between an operating position, in which it is extracted so as to engage with respective second paths defined by second actuating cams, and a non-operating position, in which it is retracted so as not to engage with said second paths.

In one aspect, said drive chain comprises: at least one selecting device acting under control upon said selector for switching the latter into or retaining it in the operating position or the non-operating position.

In one aspect, said drive chain comprises: a punch slidingly arranged in the respective longitudinal groove between the sub-needle and the selector, wherein a lower portion of the punch is engaged with the selector and an upper portion of the punch is engaged with the sub-needle, wherein the punch has a respective butt which can be engaged with respective third paths defined by third actuating cams.

In one aspect, the drive chain comprises an activating element slidingly arranged in the respective longitudinal groove between the sub-needle and the selector, wherein the activating element can be longitudinally moved with respect to the punch and with respect to the sub-needle and can be operatively engaged with the sub-needle so as to switch the butt of the sub-needle into and retain it in the respective operating position.

The Applicant has found that the invention allows to solve the problems related to the limitations of the movements of the needles, in particular of the "inactive" needle, resulting from the size of the machine, and thus to achieve the intended aim.

In particular, the Applicant has found that the activating element, which is free to move with respect to the punch and sub-needle, allows to decide where and when the radial extraction/insertion should take place, whatever the axial position of the punch and/or selector.

In other words, the punch pushes upwards upon the sub-needle and needle without causing every time the radially moving butt of the sub-needle to switch from the non-operating to the operating position, since this switching is caused by the activating element.

This characteristics allows to provide the needles with more movements with respect to the prior art and/or to reduce the axial and circumferential development of the cylinder and of the cams, the needle movements to be achieved being the same. This allows to manufacture fabrics with smaller diameter and/or with several characteristics differing one from the other and/or to reduce the inertia of the cylinder and thus to increase the working speed.

Moreover, for instance, the needle can be moved to a higher lever in non-operating position so as to perform the "flipping dial picking" without moving the lower elements, i.e. in particular the selector and/or the punch.

The solution underlying the present invention, which allows to control the extraction of the butt of the sub-needle whatever the axial position of the punch and/or selector, is particularly effective during stitch formation. "Stitch formation" means the working step during which the needle hooks a new yarn and gets down until the old stitch (previously formed)—as a result of the needle descent—from under the needle head goes over the heat, causing the knitting stitch to be completely formed. In one aspect of the invention, the butt of the sub-needle is switched into and retained in said operating position during needle descent, and in particular during the step of needle descent corresponding to stitch formation.

Further aspects of the invention are listed below.

In one aspect, the sub-needle, the punch, the selector and the activating element are flat parts. The drive chain is also known as "catenary" and is made up of the aforesaid flat parts slidingly inserted into the longitudinal grooves.

In one aspect, the drive chain is configured for decoupling an axial movement of the needle and/or of the sub-needle from an axial movement of the punch and/or of the activating element and/or of the selector.

In one aspect, the drive chain is configured for decoupling an axial movement of the activating element from an axial movement of the punch and/or of the needle and/or of the selector.

In one aspect, the drive chain is configured for decoupling the axial movement of the punch and/or of the selector from the activation/deactivation of the radially moving butt of the sub-needle.

In one aspect, the sub-needle and needle are made as one piece.

In a different aspect, the sub-needle and needle are discrete elements.

In one aspect, an upper end of the sub-needle is engaged with the needle, preferably with a two-side and/or hinge constraint.

In one aspect, the sub-needle comprises a supporting portion carrying the respective butt.

In one aspect, the activating element can be operatively engaged with the supporting portion.

In one aspect, said supporting portion is elastically movable between a first configuration, corresponding to the operating position of the butt, and a second configuration, corresponding to the non-operating position of the butt.

The Applicant has found that the elastic actuation allows to radially move the butt of the sub-needle (inactive needle) in a more effective and safer manner with respect to known movements obtained with oscillating stiff elements and/or by rotating the whole needle and/or sub-needle.

In one aspect, the supporting portion exerts an elastic restoring force upon the butt in the non-operating position of said butt.

In one aspect, in the non-operating position of said butt, said elastic force retains the supporting portion and the respective butt inside the respective groove.

The Applicant has found that the elastic restoring force ensures the radially retracted non-operating position in a safe and effective manner.

In one aspect, the activating element switches and retains the butt into the respective operating position against said elastic force.

In other words, the butt, when it is not engaged or stressed by the activating element, remains in the non-operating position thanks to the elastic restoring force and is actively moved to the operating position by means of said activating element.

In one aspect, the supporting portion comprises an elastically flexible arm extending, preferably projecting, towards the activating element. The elastic force is imparted by said elastically flexible arm.

In one aspect, the elastically flexible arm lies in the groove.

In one aspect, the elastically flexible arm extends basically parallel to an axial direction.

In one aspect, the sub-needle comprises a main body from which the elastically flexible arm extends and projects.

In one aspect, the supporting portion comprises a lower portion placed at a distal end of the elastically flexible arm, wherein the lower portion carries the butt of the sub-needle.

In one aspect, the sub-needle comprises a retaining element placed in a radially outer position with respect to the lower portion, so as to limit the radial stroke of the butt of the sub-needle.

In one aspect, the retaining element is defined by an axial extension of the sub-needle which develops from the main body and is preferably basically parallel to the elastically flexible arm.

At rest, the elasticity of the elastically flexible arm of the sub-needle retains in the non-operating position the radially moving butt, thus making the needle non-operating. The butt of the sub-needle must be activated in order to form the stitch with the needle. Thus, the butt is not free but is actively retained inside or outside the groove.

In one aspect, the sub-needle comprises an auxiliary butt.

In one aspect, the auxiliary butt radially extends from the main body of the sub-needle.

In one aspect, fifth actuating cams define fifth paths and the auxiliary butt of the sub-needle can be engaged into said fifth paths.

In one aspect, the sub-needle has an abutting surface axially pointing towards the punch.

In one aspect, said abutting surface is placed near an upper end of the sub-needle.

In one aspect, the punch extends at least partly parallel and in a radially more inner position with respect to the activating element and to the sub-needle.

In one aspect, the punch rests against a bottom surface of the respective groove.

In one aspect, the activating element and the sub-needle radially rest against the punch.

In one aspect, the punch comprises an elongated upper portion, preferably shaped as a bar, and a lower portion or foot located at a lower end of the elongated portion.

In one aspect, the activating element and the sub-needle radially rest against the elongated portion.

In one aspect, in the second configuration of the supporting portion, said supporting portion rests radially and at least partially against the punch, preferably against the elongated portion of the punch.

In one aspect, the lower portion of the punch has an abutting surface pointing towards the activating element.

In one aspect, an upper portion of the punch, preferably a distal end of the elongated upper portion, can be engaged against an abutting surface of the sub-needle, preferably by means of a single-side axial rest.

In the framework of the present invention, the wording "single-side axial rest" means a mechanical coupling or constraint between two elements, in which an axial thrust of a first element upon the second one, together with a movement of the first element towards the second element, causes a corresponding movement of the second element (integrally with the first one), whereas a movement of the first element away from the second element causes a separation between the two elements, without the second element being taken down; and vice versa.

In other words, this constraint is retained by means of a contact between the two elements when the first one moves towards the second one, whereas it is canceled when the first one moves in an opposite direction with respect to the second one, in which case there is a separation between the two elements.

In one aspect, a lower portion of the punch, preferably an abutting surface pointing towards the selector, can be engaged against an abutting surface of said selector, preferably by means of a single-side axial rest.

In one aspect, the butt of the punch extends radially from the lower portion of said punch.

In one aspect, the activating element has an upper end preferably provided with an inclined surface. Said upper end, preferably said inclined surface, cooperates with a lower portion of the supporting portion so as to switch the butt of the sub-needle into the respective operating position against the elastic force exerted by the supporting portion.

In one aspect, the inclined surface radially points outwards.

In one aspect, the lower portion of the supporting portion has an inclined surface facing the upper end of the activating element and configured for cooperating with the inclined surface of said activating element.

In one aspect, the activating element has a seat configured for receiving at least part of said lower portion and retain the butt of the sub-needle in the respective operating position and/or to axially push against the sub-needle.

In one aspect, said seat is located at said upper end of the activating element and is preferably counter-shaped to the lower portion of the supporting portion.

In one aspect, said seat develops in a continuous manner from the inclined surface of the activating element.

In one aspect, the activating element has a lower end which can be engaged against an abutting surface of the punch, preferably by means of a single-side axial rest.

In one aspect, the activating element has a respective butt.

In one aspect, fourth actuating cams define fourth paths and the butt of the activating element can be engaged into said fourth paths.

In one aspect, the butt of the activating element radially extends from an axially intermediate area of the activating element.

In one aspect, the selector comprises an axially moving element slidingly arranged in the respective longitudinal groove.

In one aspect, the axially moving element of the selector carries the respective butt.

In one aspect, the selector has an auxiliary butt.

In one aspect, the axially moving element of the selector carries the respective auxiliary butt.

In one aspect, sixth actuating cams define sixth paths and the auxiliary butt of the selector can be engaged into said sixth paths.

In one aspect, the selector comprises an axially stationary element which can be engaged by the selecting device, wherein the axially stationary element is operatively engaged by the axially moving element so as to radially move the respective butt and the auxiliary butt, if present, between the operating and non-operating position.

In one aspect, the axially stationary element is oscillating by effect of the selecting device.

In one aspect, the axially moving element is oscillating by effect of the axially stationary element.

In one aspect, the axially stationary element comprises a plurality of teeth radially pointing outwards, which can be selectively engaged by the selecting device.

In one aspect, the axially stationary element is not present and the selecting device, preferably of magnetic type, directly acts upon the axially moving element.

In one aspect, the auxiliary butt of the sub-needle, the butt of the punch and the butt of the activating element are axially moving and radially stationary.

In one aspect, the butt of the selector and the auxiliary butt of the selector are axially moving and also radially moving.

In one aspect, a maximum stroke of the sub-needle and needle, when the radially moving butt is in the non-operating position, is longer than a maximum stroke of the punch.

In one aspect, a maximum stroke of the sub-needle and needle, when the radially moving butt is in the operating position, is shorter than a maximum stroke of the sub-needle and needle when the radially moving butt is in the non-operating position.

In one aspect, a maximum stroke of the punch is longer than a maximum stroke of the axially moving element of the selector.

In one aspect, a maximum stroke of the sub-needle and needle, when the radially moving butt is in the non-operating position, is about three times a maximum stroke of the axially moving element of the selector.

In one aspect, a maximum stroke of the sub-needle and needle, when the radially moving butt is in the non-operating position, is about 1.2 times a maximum stroke of the punch.

In one aspect, the needle-holding cylinder has a reference diameter which is smaller of about 200 mm, preferably smaller of about 100 mm. "Reference diameter" means the diameter measured on the bottom surface of the axial grooves defined on the outer surface of the cylinder, in which the needles are slidingly housed. In the technical field of circular knitting machines, the bottom surfaces of the grooves are referred to as "low background"; the reference diameter is thus defined with respect to this "low background".

In one aspect, the circular machine has one or more yarn feeding points (feeds).

Preferably, the number of yarn feeding points is more than one, preferably more than two, preferably of four or above.

In one aspect, the invention relates to a method for moving the needles of a circular knitting machine, wherein preferably the machine is made according to one or more of the above aspects and/or to one or more of the appended claims and/or embodiments.

This method for moving the needles of a circular knitting machine comprises: radially moving a butt of a sub-needle, engaged with a respective needle, between an operating position, in which it is extracted so as to engage with respective first paths defined by first actuating cams and cause the activation of the needle and the stitch formation, and a non-operating position (inactive needle), in which it is retracted so as not to engage with said first paths; wherein the radial movement of the butt of the sub-needle is caused by a relative axial movement between the sub-needle and the activating element axially located below the sub-needle; wherein this relative axial movement is, at least in some steps, disconnected/independent from an axial movement of a punch and/or of a selector arranged under the needle and operatively activated by a selecting device acting under control upon said selector.

In one aspect, during the relative axial movement between the sub-needle and the activating element, an upper end, preferably an inclined surface, of the activating element cooperates with a supporting portion of the butt of the sub-needle.

In one aspect, a basically radial elastic force acts upon a supporting portion of the butt of the sub-needle so as to retain the butt in the non-operating position.

In one aspect, during the movement from the non-operating to the operating position, the upper end of the activating element acts against the elastic force.

In one aspect, during the movement from the non-operating to the operating position, an upper end of the activating element is inserted between a needle-holding cylinder and a supporting portion of the butt of the sub-needle (in particular, it is inserted between an upper portion of the butt and a supporting portion of the butt of the sub-needle).

In one aspect, the elastic force restores the butt from the operating to the non-operating position.

In one aspect, in said step of radially moving the butt of the sub-needle, said butt is switched into and retained in said operating position during needle descent, and in particular during a step of needle descent corresponding to stitch formation.

In one aspect, the punch axially pushes upwards the activating element until a butt of the activating element engages with fourth actuating cams and then said punch disengages said activating element.

In one aspect, third actuating cams, into which a butt of the punch is engaged, guide said punch axially upwards or downwards.

In one aspect, fifth actuating cams, into which an auxiliary butt of the sub-needle is engaged, guide said sub-needle axially downwards, while fourth actuating cams, into which a butt of the activating element is engaged, guide the activating element upwards until the upper end of the activating element is inserted between the needle-holding cylinder and the supporting portion of the butt of the sub-needle.

In one aspect, fifth actuating cams, into which an auxiliary butt of the sub-needle is engaged, guide said sub-needle axially upwards, while the fourth actuating cams guide the activating element downwards until the upper end of the activating element is taken out from below the supporting portion of the butt of the sub-needle.

In one aspect, the punch directly pushes against the sub-needle so as to guide it upwards.

In one aspect, the selector, preferably an axially moving element of the selector, pushes the punch axially upwards until a butt of the punch engages with third actuating cams and then disengages the punch.

In one aspect, second actuating cams, into which the butt of the selector is engaged, and/or sixth actuating cams, into which the auxiliary butt of the selector is engaged, guide said selector axially upwards or downwards.

In one aspect, an axially stationary element of the selector radially pushes upon the axially moving element of said selector so as to make it oscillate and cause the radial movement of the respective butt and auxiliary butt, if present.

In one aspect, a selecting device acts against the axially stationary element of the selector so as to make it oscillate and radially push upon the axially moving element.

In one aspect, a maximum axial stroke of an axially moving element of the selector is smaller than a maximum axial stroke of the needle and/or sub-needle and/or than a maximum axial stroke of the activating element and/or than a maximum axial stroke of the punch.

Further characteristics and advantages shall be more evident from the detailed description of a preferred embodiment of a circular knitting machine and of a method for moving the needles according to the present invention.

DESCRIPTION OF THE DRAWINGS

This description shall be made below with reference to the accompanying drawings, provided to a merely indicative and therefore non-limiting purpose, in which.

DETAILED DESCRIPTION

With reference to the figures mentioned, the numeral 1 globally designates a knitting head of a circular knitting machine according to the present invention.

The circular knitting machine comprises a basement, not shown since it is of known type, constituting the supporting structure of the machine, and said knitting head 1 mounted onto the basement.

The knitting head 1 is equipped with a needle-holding cylinder 2, with a plurality of needles 3 mounted onto the needle-holding cylinder 2, and with control means apt to selectively actuate the needles 3 so as to enable the production of a fabric.

The needle-holding cylinder 2 is usually mounted in vertical position onto the basement, with the needles 3 arranged vertically and protruding beyond an upper edge of the cylinder 2.

For instance, the needle-holding cylinder 2 has a reference diameter of about 100 mm and a height of about 450 mm.

Figure 1:
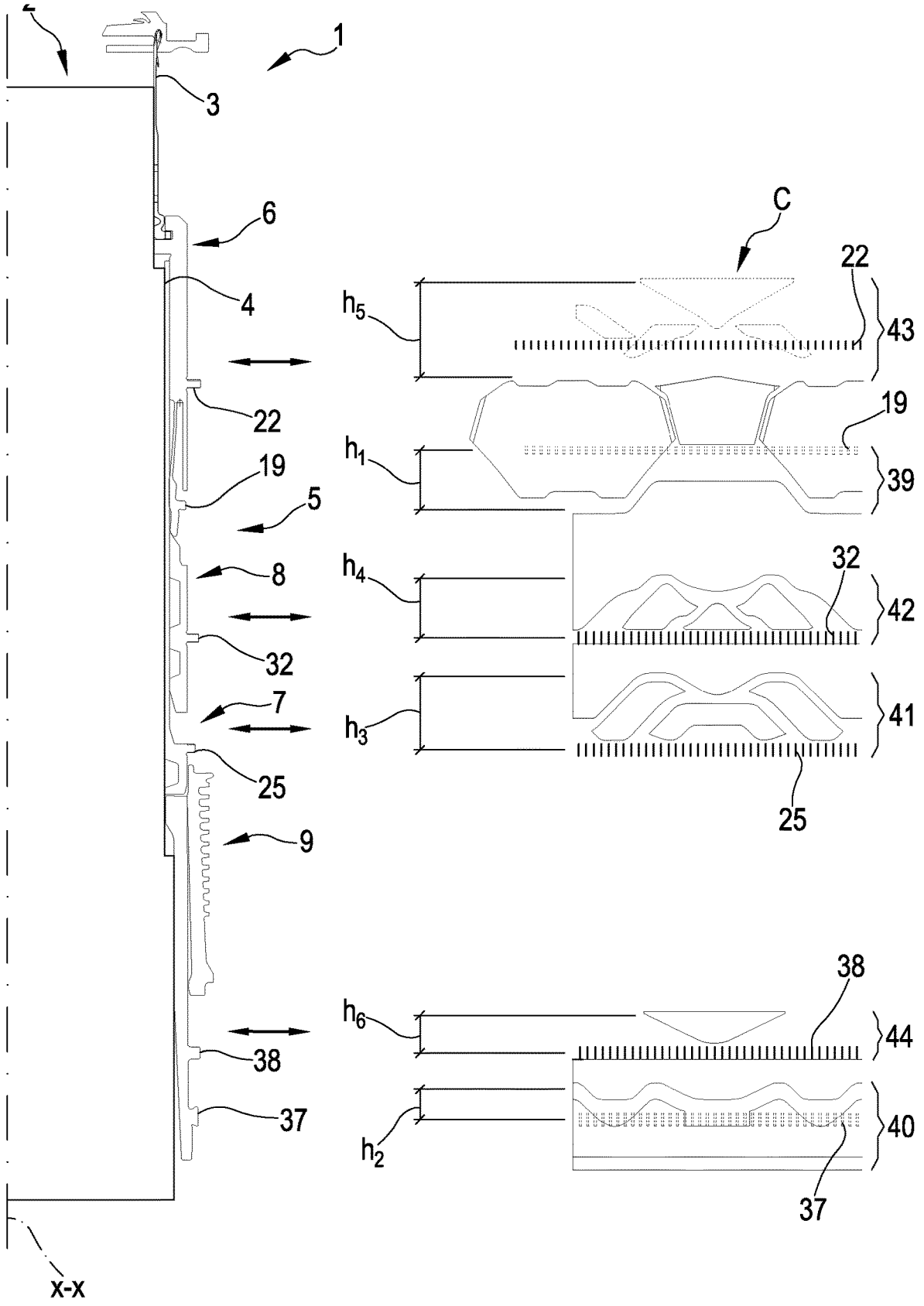
FIG. 1 shows a magnified portion of a needle-holding cylinder of a circular knitting machine according to the present invention, in which a drive chain of a needle can be seen, coupled with a length of the actuating cams developed on a plane.

As shown in FIG. 1, the needle-holding cylinder 2 has a plurality of longitudinal grooves 4 obtained on a radially outer surface of the cylinder 2. The longitudinal grooves 4 are arranged around a central axis "X-X" (vertical) of the needle-holding cylinder 2 and develop parallel to said central axis "X-X". Each longitudinal groove 4 houses a respective needle 3 and a respective drive chain 5 or "catenary" comprising a plurality of flat parts. Actuating cams "C" are arranged as a casing around the needle-holding cylinder 2 and lie facing the radially outer surface of the cylinder 2 and thus the longitudinal grooves 4 and the drive chains 5. These actuating cams "C" are defined by plates and/or grooves arranged on an inner surface of the casing.

For the sake of clarity, in FIG. 1 a length of these actuating cams "C" has been represented developed in the plane and beside the drive chain 5 coupled with one of the needles 3.

In the embodiment shown, the casing of the actuating cams "C" is basically stationary, whereas the needle-holding cylinder 2 rotates (with a continuous or alternating motion in both directions) around the central axis "X-X" so as to generate a relative rotational motion between the drive chains 5 and the actuating cams "C".

As shall be described below in further detail, the drive chains 5 can be operatively coupled with the actuating cams "C" so as to turn said relative rotational motion into axial movements of the needles 3 along the longitudinal grooves 4 so as to enable stitch formation by said needles 3. The actuating cams "C" define paths extending around the needle-holding cylinder 2, which are/can be engaged by butts belonging to the drive chains 5. Therefore, each drive chain 5 is operatively placed between the respective needle 3 and the actuating cams "C".

Suitable devices, not shown, feed the yarns to be knitted on one or more yarn feeding points (known as feeds) usually arranged above the needle-holding cylinder 2. For instance, the circular machine shown has four yarn feeding points.

Figure 2A:
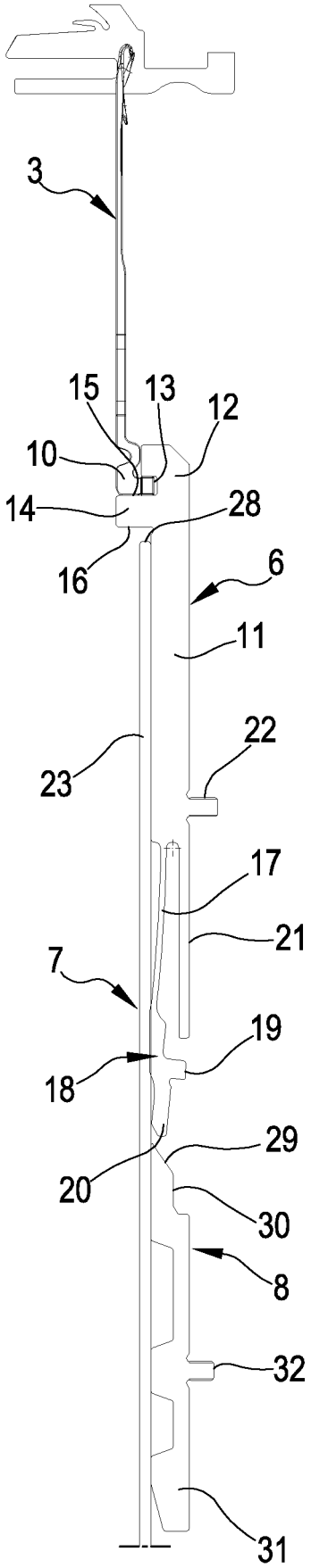
FIGS. 2*a* and 2*b* show respective magnified portions of the drive chain coupled with a needle.
Figure 2B:
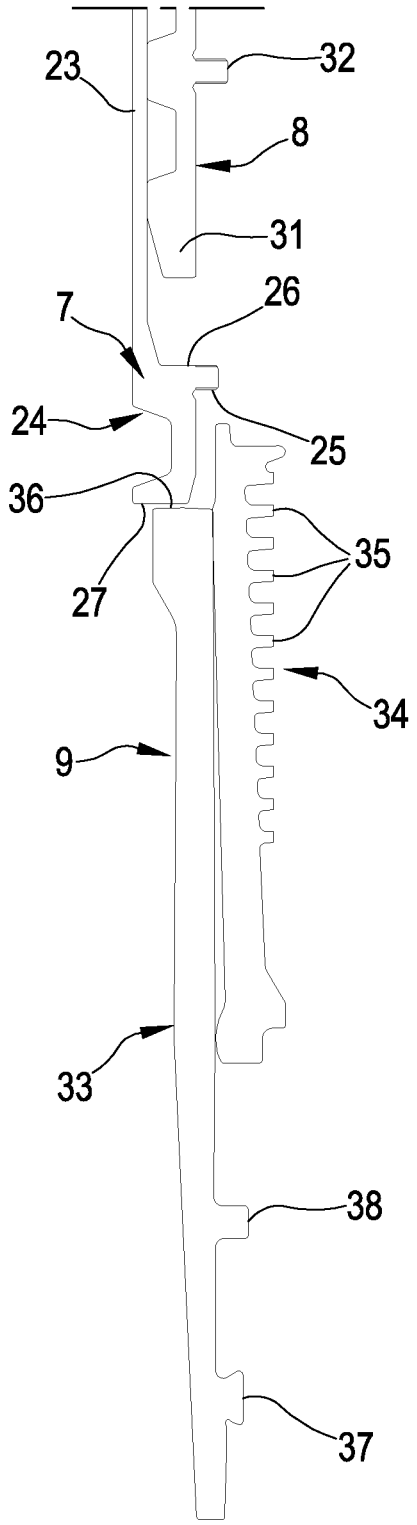

Reference shall now be made to a single drive chain 5 coupled with a respective needle 3, as shown in FIGS. 1, 2*a* and 2*b*. The relative positions of the various elements are described with reference to the drive chain 5 with the respective needle 3 correctly installed in the needle-holding cylinder 2 in vertical position.

The needle 3 is arranged on an upper edge of the needle-holding cylinder 2 and the drive chain 5 develops below the needle 3 as far as near a base of the needle-holding cylinder 2.

As can be better seen in FIGS. 2*a* and 2*b*, the drive chain 5 comprises: a sub-needle 6 arranged immediately below the needle 3, a punch 7 partially arranged below the sub-needle 6, an activating element 8 radially beside the punch 7 and placed below the sub-needle 6, a selector 9 positioned below the punch 7.

The needle 3 has a foot 10 shaped as a kind of hook. When the needle 3 is correctly positioned in the longitudinal groove 4, the foot 10 is oriented radially outwards.

The sub-needle 6 has a main body 11. An upper end 12 of the main body 11 has a seat 13 and a projection 14 located just below the seat 13. The projection 14 is provided with an upper surface 15 developing in a continuous manner from the seat 13, and with an opposed lower abutting surface 16. When the sub-needle 6 is correctly positioned in the longitudinal groove 4, the seat 13 and the projection 14 face radially towards the inside of said groove 4.

The needle 3 is firmly connected to the sub-needle 6 by the insertion of the foot 10 into the seat 13. The connection between the foot 10 and the seat 13 is two-side, i.e. the needle 3 and the sub-needle 6 move integrally along the longitudinal groove 4. The connection between the foot 10 and the seat 13 constitutes a kind of hinge since the needle 3 and the sub-needle 6 are mutually integral in their vertical axial movement, but can slightly oscillate one with respect to the other on the mutual connection. This hinge moves along a longitudinal groove 4 base on the axial movement of the needle 3 and the sub-needle 6 which are mutually integral. The foot 10 can be easily connected to or disconnected from the seat 13 so as to make it easier to assemble or disassemble both elements.

In a different embodiment, not shown, the sub-needle and needle are made as one piece.

An elastically flexible arm 17 extends and projects from the main body 11 and faces axially downwards, i.e. towards the activating element 8. A lower portion 18 placed at a distal end of the elastically flexible arm 17 carries a radially moving butt 19 of the sub-needle 6. Said lower portion 18 ends with a protrusion 20 which is rounded and/or provided with an inclined surface. The elastically flexible arm 17 and the lower portion 18 constitute an elastically moving supporting portion for the radially moving butt 19.

An axial extension 21 develops from the main body 11 downwards and parallel to the central axis "X-X". This axial extension 21 is located in a radially outer position with respect to the flexible arm 17 and is basically parallel to said flexible arm 17. The length of the axial extension 21 is smaller than an overall length of the supporting portion 17, 18, so that the radially moving butt 19 is still located below an end of said axial extension 21. As shall be more evident below, this axial extension 21 constitutes a retaining element for a radial stroke of the butt 19 of the sub-needle 6. As a matter of fact, the elastic flexibility of the elastically flexible arm 17 allows the lower portion 18 and the butt 19, when they are subjected to external stresses, to move along a basically radial path between an operating position, in which the butt 19 is extracted from the longitudinal groove 4, and a non-operating position, in which the butt 19 is retracted into the longitudinal groove 4. In the extracted position, the lower portion 18 rests against the axial extension 21. In both position, the elastically flexible arm 17 lies in the groove 4 (except for the butt 19 only, which in the extracted position radially rises from the groove 4).

The supporting portion 17, 18 as a whole is therefore elastically movable between a first configuration, corresponding to the operating position of the butt 19, and a second configuration, corresponding to the non-operating position of the butt 19.

The sub-needle 6 further comprises an auxiliary butt 22 extending radially from the main body 11 of the sub-needle 6. In the embodiment shown, this auxiliary butt 22 is connected to the main body 11 at a root portion of the axial extension 21.

The punch 7 comprises an elongated upper portion 23 shaped as a bar, and a lower portion 24 or foot located at a lower end of the elongated portion 23. The lower portion 24 carries a respective butt 25 developing radially and has an upper abutting surface 26 facing upwards, i.e. towards the sub-needle 6 and towards the activating element 8, and a lower abutting surface 27 facing downwards, i.e. towards the selector 9.

The punch 7 lies against a bottom surface of the longitudinal groove 4 and its radial position is stationary, as is the position of the respective butt 25, whereas said punch 7 can slide axially in said groove 4.

The main body 11 of the sub-needle 6 lies in a radially outer position with respect to the elongated upper portion 23 of the punch 7 and rest, always radially, against said elongated upper portion 23. The projection 14 of the sub-needle 6 lies against the bottom surface of the longitudinal groove 4 and a distal end 28 of the elongated upper portion 23 of the punch 7 still lies below the projection 14 and faces the lower abutting surface 16 of said projection 14.

Said distal end 28 can be engaged against the abutting surface 16 of the sub-needle 6 by means of single-side axial rest.

The elastic action exerted by the elastically flexible arm 17 radially pushes the lower portion 18 towards the elongated upper portion 23. In the configuration shown in FIGS. 1, 2*a* and 2*b*, the elastically flexible arm 17 retains the lower portion 18 against the elongated upper portion 23. In other words, the supporting portion 17, 18 exerts an elastic restoring force upon the butt 19 in the non-operating position of said butt 19 and, in said non-operating position, said elastic force retains the supporting portion 17, 18 and the respective butt 19 inside the groove 4.

Also the activating element 8 radially rests against the elongated upper portion 23 and is axially placed between the sub-needle 6 and the lower portion 24 of the punch 7.

The activating element 8 has an upper end provided with an inclined surface 29 which faces radially outwards and axially upwards, i.e. towards the sub-needle 6. In other words, the inclined surface 29 progressively approaches the distal end 28 of the punch 7 rising towards the sub-needle 6.

The inclined surface 29 cooperates with the protrusion 20 of the supporting portion 17, 18, so as to switch the butt 19 of the sub-needle 6 into the respective operating position against the elastic force exerted by the supporting portion 17, 18. The coupling between the inclined surface 29 and the protrusion 20 constitutes, from a cinematic point of view, a flat cam, where a rising of the inclined surface 29 causes a radial rotation, towards the outside of the cylinder (i.e. towards the outside of the groove 4), of the butt 19 so as to switch it into the respective operating position.

The activating element 8 further has a seat 30 obtained on a radially outer edge of said activating element 8 and is near the inclined surface 29. Said seat 30 develops in a continuous manner from the inclined surface 29 of the activating element 8. The seat 30 is counter-shaped to the lower portion 18 of the supporting portion 17, 18 so as to house said lower portion 18 and retain the butt 19 of the sub-needle 6 in the respective operating position against the elastic force exerted by the arm 17 and/or to push axially against the sub-needle 6.

The activating element 8 has a lower end 31 which can be engaged against the abutting surface 26 of the punch 7 by means of a single-side axial rest.

A respective butt 32 developing along a radial direction is located in an axially intermediate area of the activating element 8. The activating element 8 rests radially against the elongated upper portion 23 and is free to slide axially with respect to said elongated upper portion 23. The butt 32 of the activating element 8 is radially stationary and axially moving.

The selector 9 comprises an axially moving element 33 slidingly arranged in the respective longitudinal groove below the punch 7, and an axially stationary element 34 which can be engaged by the selecting device, not shown and e.g. per se known (e.g. a selecting device with piezoelectric levers). The axially stationary element 34 is located in a radially outer position with respect to the axially moving element 33 and has a plurality of radial teeth 35 placed side by side like a comb.

An upper end of the axially moving element 33 of the selector 9 has a respective abutting surface 36 pointing upwards and facing the lower abutting surface 27 of the punch 7. These abutting surfaces 27, 36 can be engaged one against the other by means of a single-side axial rest.

A lower portion of the axially moving element 33 of the selector 9 carries a respective butt 37 and a respective auxiliary butt 38 which extend radially outwards. The auxiliary butt 38 is located in an upper axial position with respect to the butt 37.

A radially inner edge of the axially moving element 33 and/or a bottom surface of the groove, against which said edge rests partially, are shaped so as to allow an oscillation of said axially moving element 33.

Also the axially stationary element 34 can oscillate by effect of the selecting device. The selecting device has a plurality of elements (e.g. a plurality of levers with piezoelectric actuation) which selectively engage the radial teeth 35 of the axially stationary element 34 and cause the rotation of said axially stationary element 34 acting in its turn against the axially moving element 33.

A radially inner edge of the axially stationary element 34 and/or a radially outer edge of the axially moving element 33 are shaped so as to allow a relative oscillation of said two elements.

In particular, the thrust of the axially stationary element 34 upon the axially moving element 33 allows said axially moving element 33 to oscillate between an operating position, in which the butt 37 and the auxiliary butt 38 are extracted from the groove 4, and a non-operating position, in which the butt 37 and the auxiliary butt 38 are retracted in said groove 4.

Figure 2C:
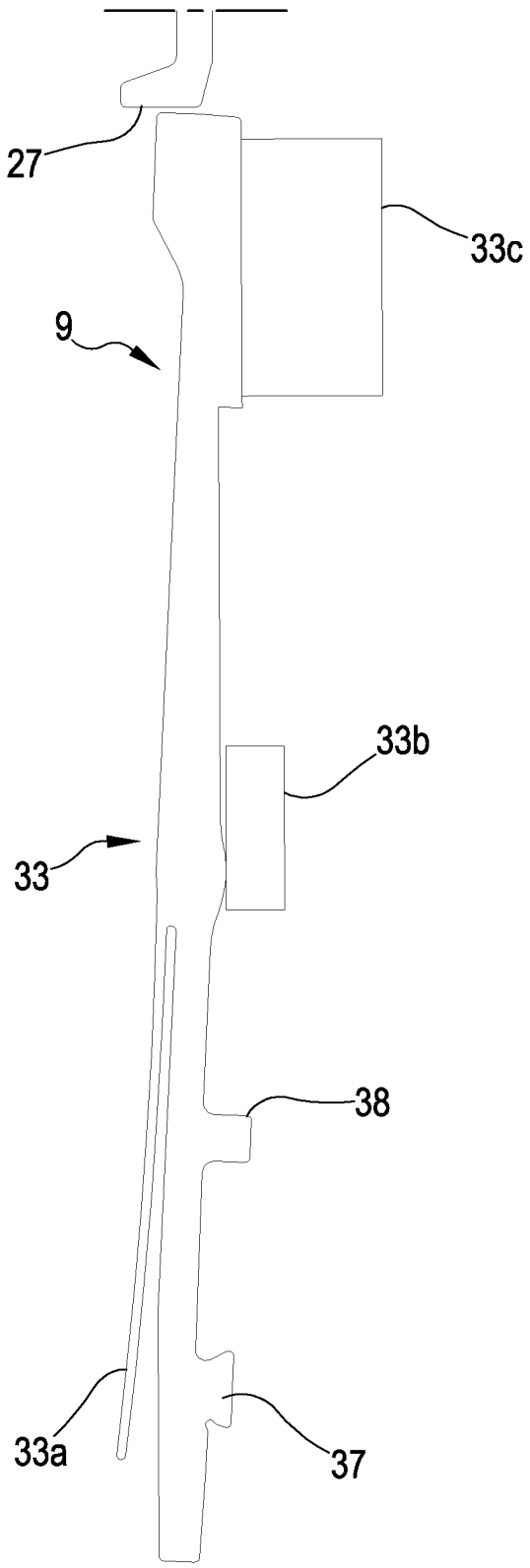
FIG. 2*c* shows a variant of an element of the drive chain.

In a different embodiment of the selector 9, shown in FIG. 2*c*, the axially stationary element is absent. The axially moving element 33 of the selector 9 comprises an elastically flexible extension 33*a* which extend downwards in a radially inner position with respect to the butt 37 and to the auxiliary butt 38 and lies in contact with a bottom surface of the groove 4. A stationary contrasting cam 33*b* is placed in a radially outer position with respect to the axially moving element 33 and rests against an axially intermediate ridge of the axially moving element 33. A stationary magnetic actuator 33*c* is placed at an upper end of the axially moving element 33. The force of the magnetic actuator 33*c* together with the elastic force exerted by the elastically flexible extension 33*a* and with the action of the contrasting cam 33*b* cause the oscillation of the axially moving element 33. The magnetic actuator 33*c* can be selectively actuated so as to cause—when suitable—the oscillation of the axially moving element 33 included in the selector being part of the drive chain coupled with a given needle.

As can be noted, the butt 37 and the auxiliary butt 38 of the selector 9 are both axially and radially moving; the auxiliary butt 22 of the sub-needle 6, the butt 25 of the punch 7 and the butt 32 of the activating element 8 are axially moving and radially stationary; the butt 19 of the sub-needle 6 is axially and radially moving.

The radially stationary butts 22, 25, 32 always lie outside the longitudinal groove 4. The radially moving butts 19, 37, 38 are retracted in the longitudinal groove when they are in the respective non-operating positions and lie outside the longitudinal groove 4 when they are in the respective operating positions.

The actuating cams "C" are configured for receiving and engaging the radially stationary butts 22, 25, 32 and the radially moving butts 19, 37, 38.

As can be seen in FIG. 1, the actuating cams "C" comprise first actuating cams 39 placed axially on the sub-needle 6 and configured for receiving and engaging the radially moving butt 19 of said sub-needle 6. The first actuating cams 39 define first paths into which the radially moving butt 19 of the sub-needle 6 can be engaged. The radially moving butt 19 of the sub-needle 6 in the operating position is extracted from the groove 4 so as to engage with these first paths and cause the activation of the needle 3 and stitch formation. The radially moving butt 19 of the sub-needle 6 in the non-operating position is retracted so as not to engage with said first paths. The actuating cams "C" comprise second actuating cams 40 placed on a base of the needle-holding cylinder 2 and configured for receiving and engaging the butt 37 of the axially moving element 33 of the selector 9. The second actuating cams 40 define second paths into which the butt 37 of the axially moving element 33 can be engaged. The butt 37 of the selector 9 in the operating position is extracted from the groove 4 so as to engage with these second paths. The butt 37 of the selector 9 in the non-operating position is retracted so as not to engage with said second paths.

The actuating cams "C" comprise third actuating cams 41 placed axially on the lower portion 24 of the punch 7 and configured for receiving and engaging the butt 25 of said punch 7. The third actuating cams 41 define third paths into which the radially stationary butt 25 of the punch 7 can be engaged. As can be noted, the third paths defined by the third actuating cams 41 comprise a basic path at a constant axial height, i.e. lying on a circumference, and paths with a variable axial height, with ascents and descents. The third actuating cams 41, into which the butt 25 of the punch 7 is engaged, are thus configured for guiding said punch 7 axially upwards or downwards.

The actuating cams "C" comprise fourth actuating cams 42 placed axially just above the third actuating cams 41 and on the activating element 8 and configured for receiving and engaging the butt 32 of said activating element 8. The fourth actuating cams 42 define fourth paths into which the radially stationary butt 32 of the activating element 8 can be engaged. As can be noted, the fourth paths defined by the fourth actuating cams 42 comprise a basic path at a constant axial height, i.e. lying on a circumference, and paths with a variable axial height, with ascents and descents.

The actuating cams "C" comprise fifth actuating cams 43 placed axially just above the first actuating cams 39 and on the sub-needle 6 and configured for receiving and engaging the auxiliary butt 22 of the sub-needle 6. The fifth actuating cams 43 define fifth paths into which the radially stationary auxiliary butt 22 of the sub-needle 6 can be engaged. As can be noted, the fifth paths defined by the fifth actuating cams 43 comprise a basic path at a constant axial height, i.e. lying on a circumference, and paths with a variable axial height, with ascents and descents. At least some of the fifth actuating cams 43 are radially movable since they can be guided to a non-operating position inside the casing and therefore cannot be engaged by the butt 22 of the sub-needle 6 which is radially stationary.

As shown in FIGS. 4*a*-4*d*, the fifth actuating cams have been represented with dashed lines when they lie in the non-operating position inside the casing, and have been represented with solid lines when they are operating, i.e. extracted and protruding with respect to a bottom surface of the casing.

The actuating cams "C" comprise sixth actuating cams 44 placed just above the second actuating cams 40 and configured for receiving and engaging the auxiliary butt 38 of the axially moving element 33 of the selector 9. The sixth actuating cams 44 define sixth paths into which the auxiliary butt 38 of the axially moving element 33 can be engaged. The auxiliary butt 38 of the selector 9 in the operating position is extracted so as to engage with these sixth paths. The auxiliary butt 38 of the selector 9 in the non-operating position can be retracted so as not to engage with said sixth paths. As can be noted, the sixth paths defined by the sixth actuating cams 44 comprise a basic path at a constant axial height, i.e. lying on a circumference, and paths with a variable axial height, with ascents and/or descents. The second actuating cams 40, into which the butt 37 of the selector 9 is engaged, and/or the sixth actuating cams 44, into which the auxiliary butt 38 of the selector 9 is engaged, guide said selector 9 axially upwards or downwards.

As can be noted from FIG. 1, each of the first, second, third, fourth, fifth and sixth paths has a respective first, second, third, fourth, fifth and sixth axial extension h1, h2, h3, h4, h5, h6. "Axial extension" of the paths means the distance, measured parallel to the central axis "X-X", between points of a path that are most distance one from the other. In other words, the axial extension is the maximum axial length which the butts 19, 22, 25, 32, 38, 37 can go over while they are guided in the respective paths and/or by the respective cams 39, 40, 41, 42, 43, 44.

The maximum stroke of the sub-needle 6 and of the needle 3 corresponds to the fifth axial extension h5. The maximum stroke of the sub-needle 6 and of the needle 3 can be limited by the radially moving butt 19 in the operating position and in this case corresponds to the first axial extension h1. The maximum stroke of the activating element 8 corresponds to the fourth axial extension h4. The maximum stroke of the punch 7 corresponds to the third axial extension h3. The maximum stroke of the axially moving element 33 of the selector 9 corresponds to the second and sixth axial extension h2, h6.

As can be noted from FIG. 1, the maximum stroke of the sub-needle 6 and of the needle 3, when the radially moving butt 19 is in the non-operating position (fifth axial extension h5), is longer than the maximum stroke of the punch 7 (third axial extension h3), which is in its turn longer than the maximum stroke of the axially moving element 33 of the selector 9 (second and sixth axial extension h2, h6). For instance, the maximum stroke of the sub-needle 6 and of the needle 3, when the radially moving butt 19 is in the non-operating position, is about 1.2 times the stroke of the punch 7 and is about three times the maximum stroke of the axially moving element 33 of the selector 9.

In the embodiment shown, the maximum stroke of the sub-needle 6 and of the needle 3, when the radially moving butt 19 is in the operating position (first axial extension h1), is shorter than the maximum stroke of the sub-needle 6 and of the needle 3 when the radially moving butt 19 is in the non-operating position (fifth axial extension h5). For instance, the fifth axial extension h5 is about two times the first axial extension h1.

The maximum stroke of the activating element 8 (fourth axial extension h4) is shorter than the maximum stroke of the sub-needle 6 and of the needle 3 when the radially moving butt 19 is in the non-operating position (fifth axial extension h5), and is longer than the maximum stroke of the axially moving element 33 of the selector 9.

For instance, the fourth axial extension h4 is about two times the second and sixth axial extension h2, h6 and is about ⅔ of the fifth axial extension h5.

The drive chain 5 is thus configure for decoupling the axial movement of the needle 3 and/or of the sub-needle 6 from the axial movement of the punch 7 and/or of the selector 9; the axial movement of the activating element 8 can actually be decoupled from the one of the punch 7 and/or of the needle 3 and/or of the sub-needle 6 and/or of the selector. 9.

Moreover, the drive chain 5 is configured for decoupling the axial movement of the punch 7 and/or of the selector 9 from the activation/deactivation of the radially moving butt 19 of the sub-needle 6 (switching between the non-operating position or inactive needle and the operating position).

Figures 3A, 3B, 3C, 3D, 3E, 3F:
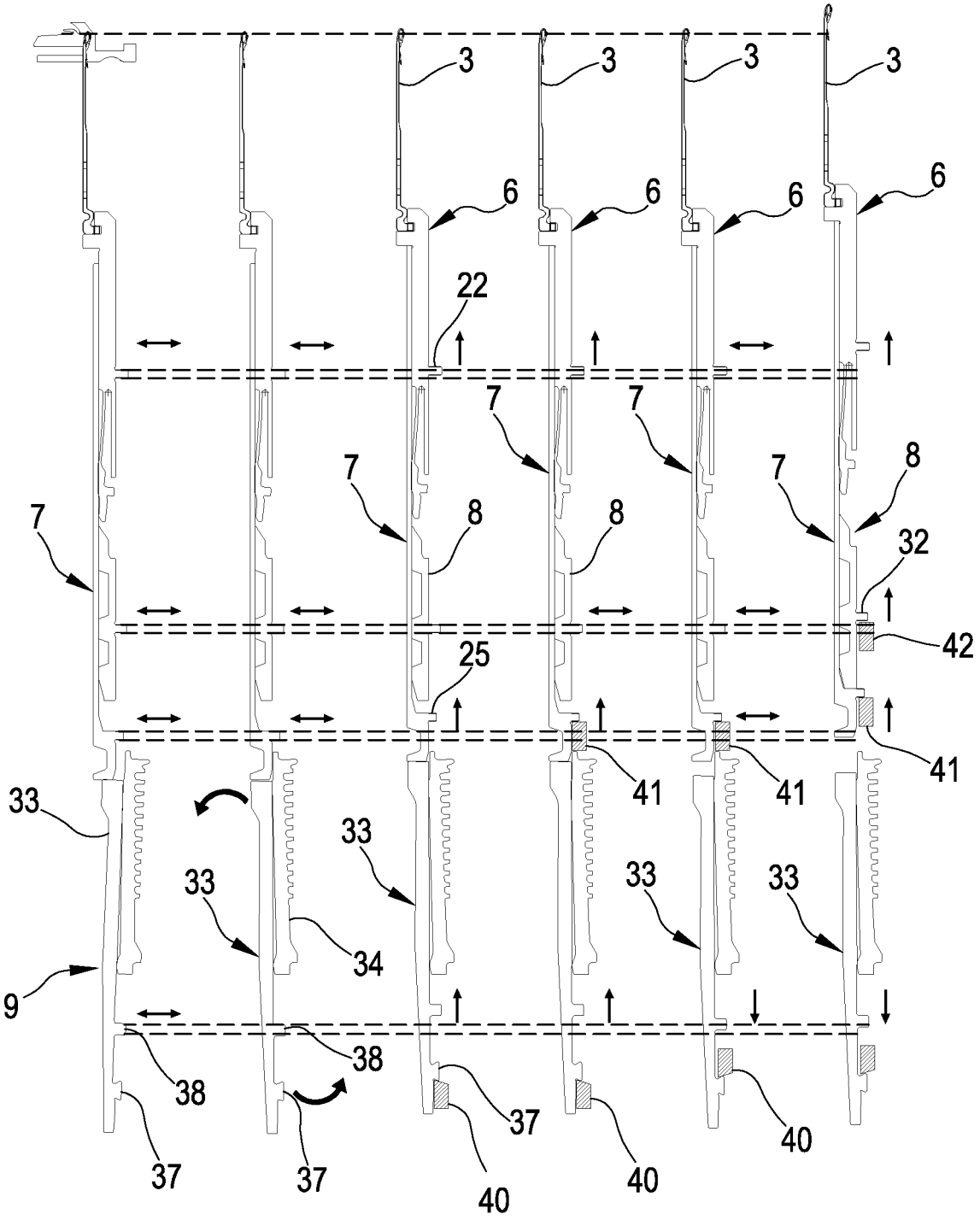
FIGS. 3*a* -3*i* and 3*l*-3*t* show a series of possible configurations of the drive chain.
Figures 3G, 3H, 3I, 3L, 3M, 3N:
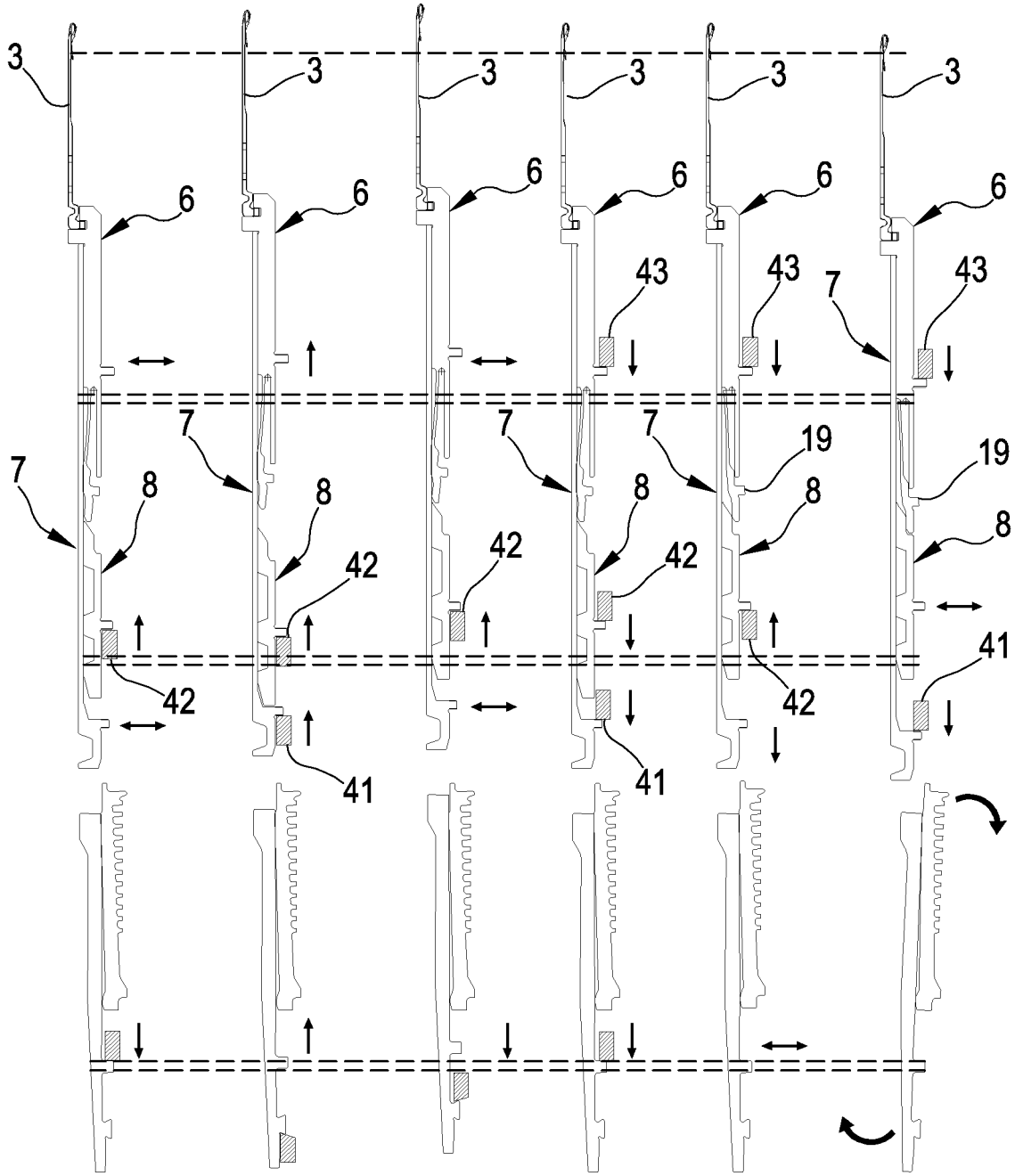
Figures 3O, 3P, 3Q, 3R, 3S, 3T:
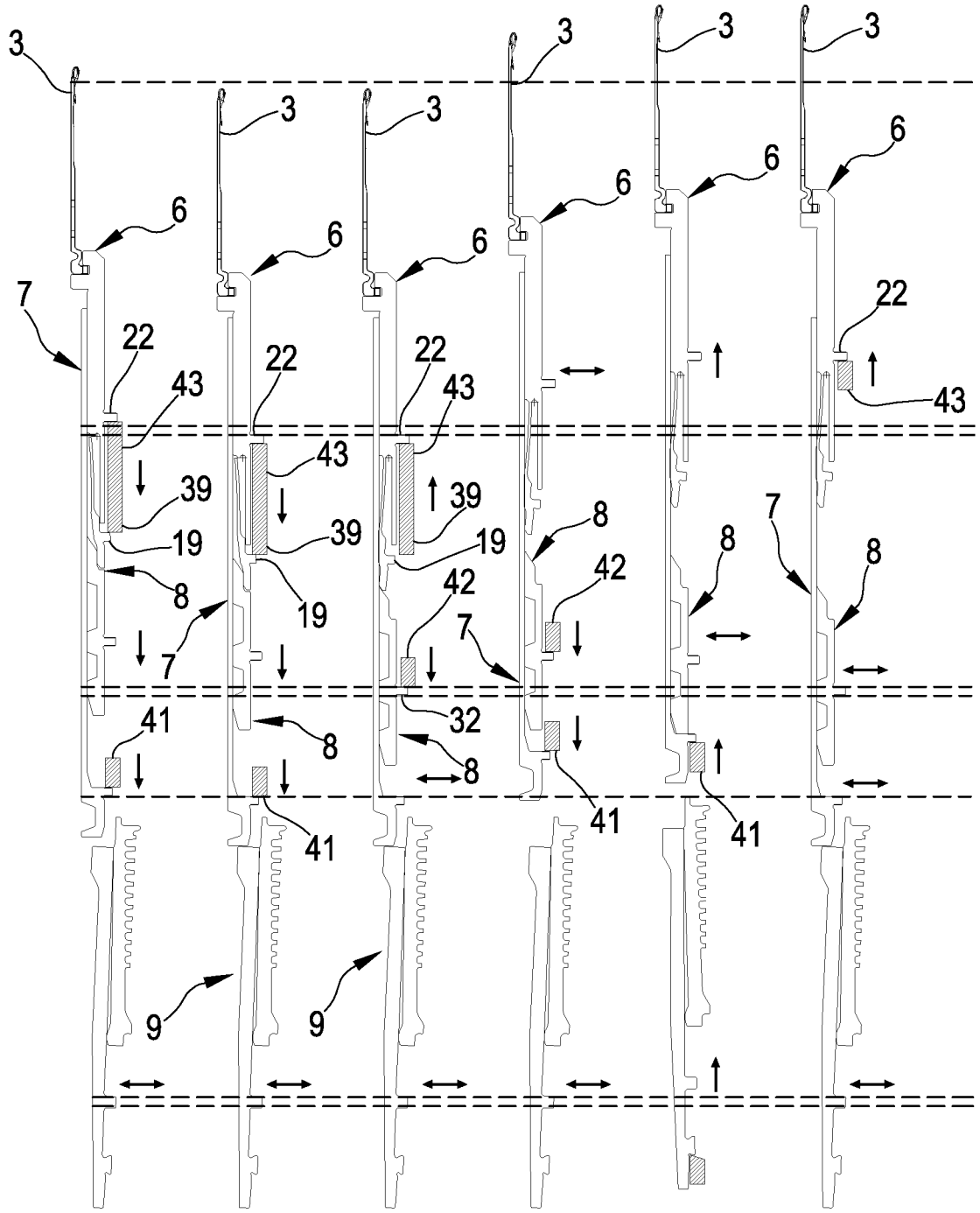

The drive chain described and constituting the object of the present invention can be arranged, cooperating with the actuating cams "C" and with the selecting device, according to a plurality of configurations such as shown e.g. in FIGS. 3*a*-3*t*.

In FIG. 3*a* the butt 37 is retracted in the respective longitudinal groove 4 or disengaged from the respective second actuating cams 40. The axially moving element 33 of the selector 9 is in the axially lowest position, the punch 7 rests on the axially moving element 33 and its butt 25 follows the basic path at a constant axial height of the third actuating cams 41. Also the butt 32 of the activating element 8 follows its basic path at a constant axial height of the fourth actuating cams 42. The auxiliary butt 22 of the sub-needle 6 follows its basic path at a constant axial height of the fifth actuating cams 43. The activating element 8 is axially distanced from the sub-needle 6 and the butt 19 of the sub-needle 6 is in the non-operating position, disengaged from the respective first actuating cams 39. The distal end 28 of the punch 7 is distanced from the lower abutting surface 16 of the projection 14. The height of the needle 3 is determined by the axial position of the auxiliary butt 22.

In FIG. 3*b*, the selecting device acts upon the axially stationary element 34 and causes the rotation thereof and therefore of the axially moving element 33, so that the butt 37 and the auxiliary butt 38 are extracted from the longitudinal groove 4 and engage into the second and sixth actuating cams 40, 44. The other elements are in the position of FIG. 3*a*.

In FIG. 3*c*, the butt 37 of the axially moving element 33 is pushed axially upwards by the second actuating cams 40 and pushes against the punch 7, which in its turn pushed against the sub-needle 6. As a result, when the butt 25 of the punch 7, and possibly the auxiliary butt 22 of the sub-needle 6, find the respective paths at a variable axial height, get therein and the punch 7 and the sub-needle 6 with the needle 3 start to rise. The activating element 8 is axially stationary since it is axially disconnected from the others.

In FIG. 3*d*, the punch 7, the sub-needle 6 and the needle 3 move upwards under the thrust exerted by the third actuating cams 41 and/or by the second actuating cams 40. The punch 7 directly pushes against the sub-needle 6 so as to guide it upwards. The activating element 8 is axially stationary.

In FIG. 3*e*, the punch 7, the sub-needle 6 with the needle 3 are supported by the third actuating cams 41, whereas the axially moving element 33 is guided downwards by the second actuating cams 40 and is disconnected from the punch 7.

In FIG. 3*f*, the third actuating cams 41 push upwards the punch 7 which, beyond lifting the sub-needle 6 and the needle 3, gets in contact with the activating element 8 and pushed it upwards. As a result, when the butt 32 of the activating element 8 finds the paths at a variable axial height of the fourth actuating cams 42, it engages therein and can be lifted by them and then said punch 7 can disengage from said activating element 8. In the meantime, the axially moving element 33 is axially distanced from the punch 7.

In FIG. 3*g*, the sub-needle 6 with the needle 3 and the punch 7 are axially stationary, whereas the fourth actuating cams 42 lift the activating element 8 which approaches the sub-needle 6 without engaging it.

In FIG. 3*h*, the third actuating cams 41 guide the punch 7, the sub-needle 6 and the needle 3 upwards moving the sub-needle 6 away from the activating element 8.

In FIG. 3*i*, whereas the punch 7, the sub-needle 6 and the needle 3 are axially stationary, the activating element 8 is moved upwards by the fourth actuating cams 42.

In FIG. 3*l*, the third actuating cams 41 and the fifth actuating cams 43 guide the punch 7, the sub-needle 6 and the needle 3 axially downwards. The fourth actuating cams 41 also guide the activating element 8 downwards.

In FIG. 3*m*, the fifth actuating cams 43 guide the punch 7, the sub-needle 6 and the needle 3 axially downwards, whereas the fourth actuating cams 42 push upwards the activating element 8 until the inclined surface 29 is inserted axially below the protrusion 20, placing itself radially between the punch 7 and said protrusion 20, against the elastic force exerted by the supporting portion 17, 18.

In FIG. 3*n*, the third actuating cams 41 and the fifth actuating cams 43 guide the punch 7, the sub-needle 6 and the needle 3 downwards, whereas the activating element ends its stroke and is axially stationary, with the protrusion 20 positioned in the seat 30 and the butt 19 of the sub-needle 6 in the respective operating position.

In FIG. 3*o*, the butt 19 and the auxiliary butt 22 of the sub-needle 6 are both engaged by the respective first and fifth actuating cams 39, 43 and move axially integral downwards also together with the activating element 8. The punch 7 is distanced from the sub-needle 6 and is moved downwards by the third actuating cams 41.

As can be noted in FIGS. 3*e*-3*o*, the axially moving element 33 is always distanced from the punch 7.

In FIG. 3*p*, the butt 19 and the auxiliary butt 22 of the sub-needle 6 are both engaged by the respective first and fifth actuating cams 39, 43 and move axially integral downwards also together with the activating element 8. The punch 7 rests against the selector 9.

In FIG. 3*q*, the sub-needle 6 and the needle 3 are guided upwards by the fifth actuating cams 43, the activating element 8 is guided downwards by the fourth actuating cams 42 and disengages from the sub-needle 6, so that the butt 19 of the sub-needle 6 is switched back to the non-operating condition by the elastic force of the elastically flexible arm 17. Then, the basically radial elastic force acts upon the supporting portion 18 of the butt 19 of the sub-needle 6 so as to retain the butt 19 in the non-operating position.

In FIG. 3*r*, the third actuating cams 41 and the fourth actuating cams 42 guide the punch 7 and the activating element 8, respectively, downwards, whereas the needle 3 and the sub-needle 6 remain stationary in a floated needle position.

In FIG. 3*s*, the needle and the sub-needle 6 are pushed upwards, whereas the activating element 8 is in a stationary axial position and the punch 7 is guided against the activating element 8 by the third actuating cams 41.

FIG. 3*t* shows the picking position of the needle 3, in which the needle 3 and the sub-needle 6 are pushed upwards by the fifth actuating cams 43 and are distanced from the punch 7 and from the activating element 8. As can be noted in FIGS. 3*r* and 3*s*, the axially moving element 33 is axially distanced from the punch 7.

By combining the configurations disclosed above into predefined sequences thanks to the structure of the actuating cams, the needle 3 is moved so as to execute the required knitting operations.

By mere way of example, FIGS. 4*a*-4*d* show the flipping dial picking sequence. The sense of rotation of the needle-holding cylinder 2 with respect to the casing of the actuating cams "C" is indicated by arrow "R". The lengths of the paths of the butts engaged into the respective cams have been represented with vertical bars, whereas the lengths of the paths of the butts disengaged from the respective cams have been represented with horizontal dashed lines. The path of the terminal end of the needle 3 has not been represented, but this path is always parallel to the one of the butt 22 of the sub-needle 6 to which the needle 3 is integrally connected during the vertical movement.

Figure 4A:
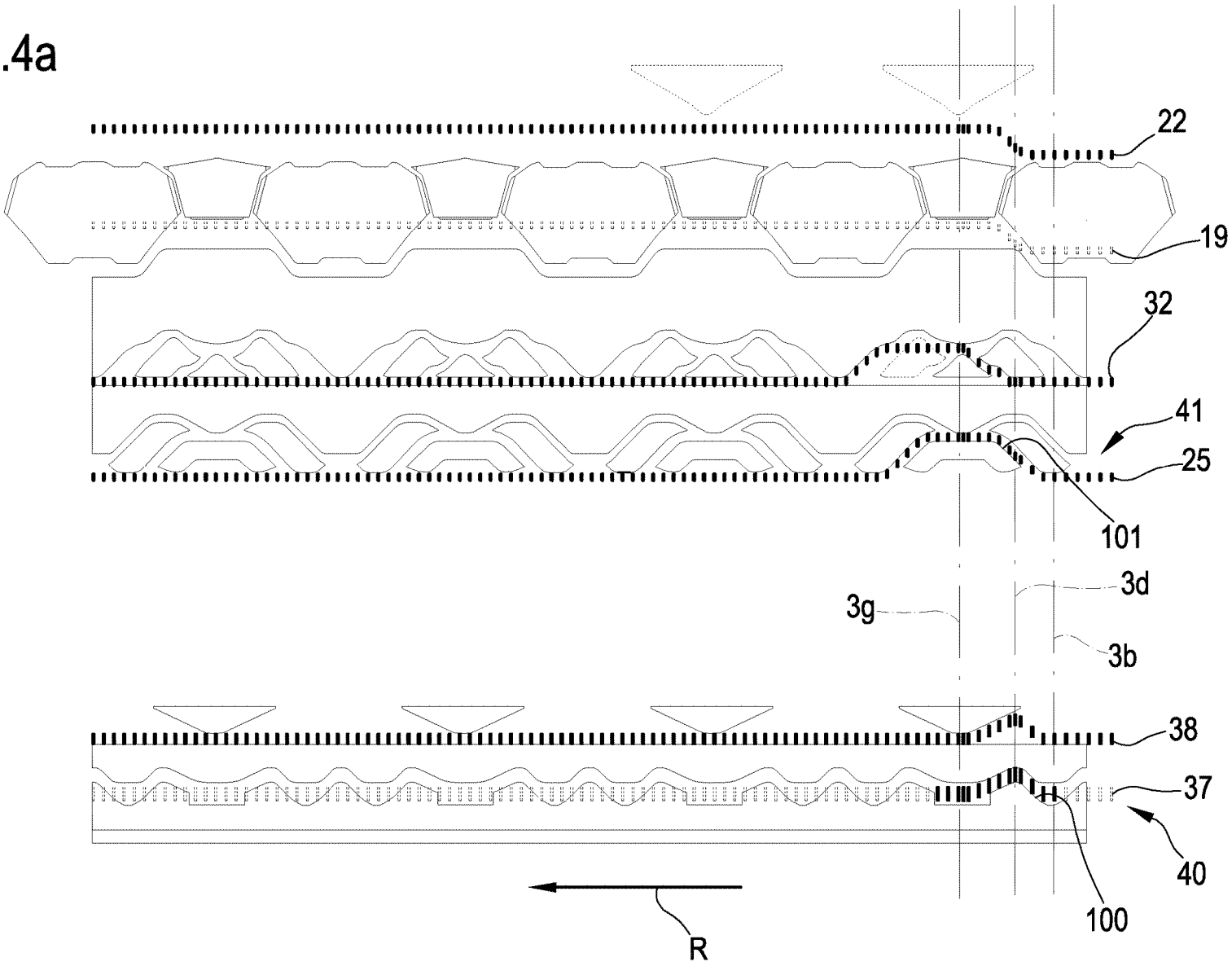
FIGS. 4*a*-4*d* show a length of the actuating cams developed on a plane with respective paths followed by the drive chain.

FIG. 4*a* shows the step with withdrawn needle 3. The vertical lines 3*b*, 3*d* and 3*g* represent three positions of the needle 3 and of the drive chain 5 whose configurations correspond to those of FIGS. 3*b*, 3*d* and 3*g*. This means that, looking at FIG. 4*a* from right to left, the butt 37 of the selector 9 is activated and engages with the second actuating cams 40 rising upwards thanks to the ascent 100 and pushing the punch 7, the sub-needle 6 and the needle 3 upwards, so that the butt 25 of the punch 7 gets engaged and follows the ascent 101 of the third actuating cams 41. The fifth actuating cams 43 are in the non-operating position. The radially moving butt 19 of the sub-needle 6 is in the non-operating position. The needle 3 is guided into the position of FIG. 3*g* by the third actuating cams 41 while the punch 7 disconnects from the selector 9.

Figure 4B:
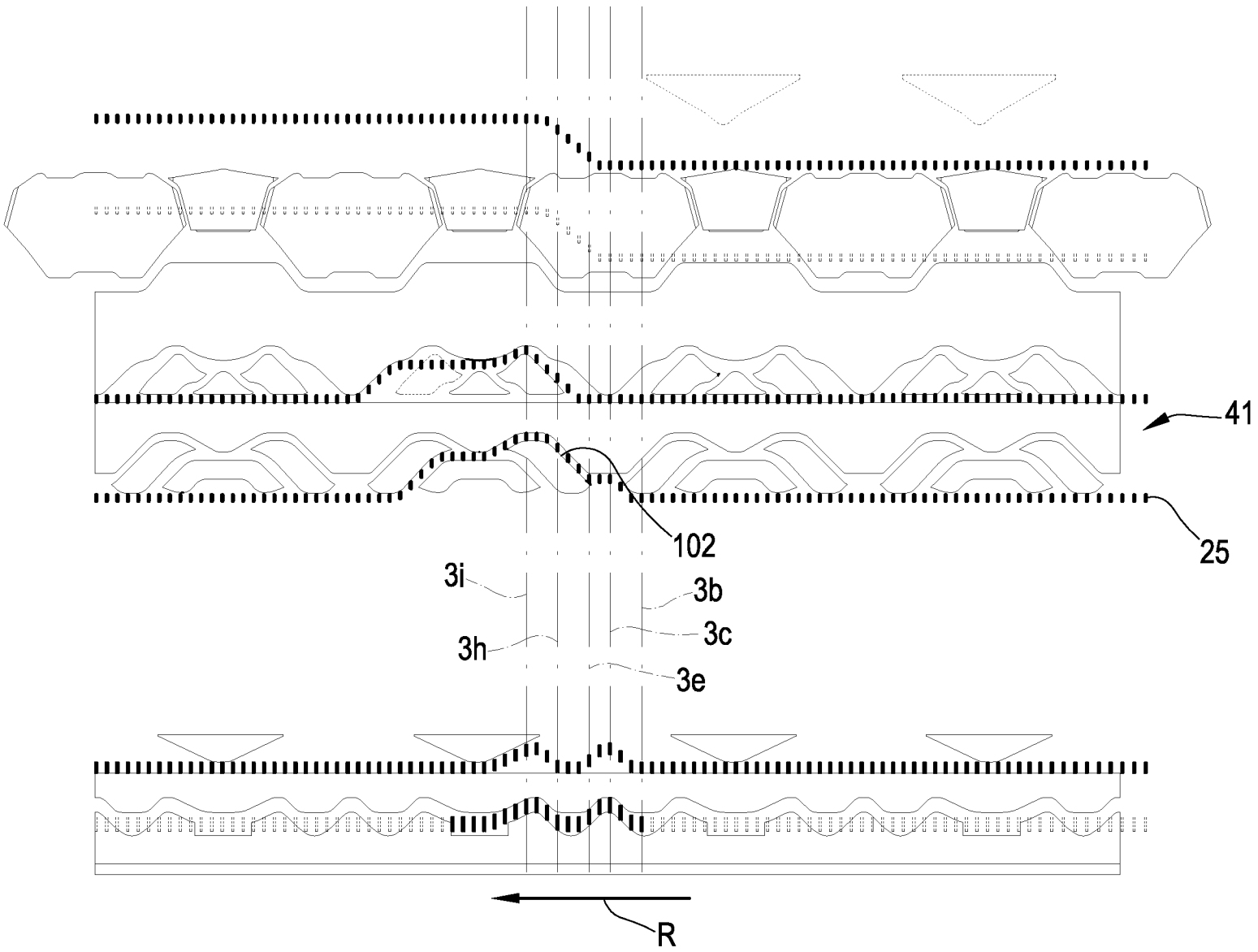

FIG. 4*b* shows the step with cast-off needle 3. The vertical lines 3*b*, 3*c*, 3*e*, 3*i* and 3*h* represent five positions of the needle 3 and of the drive chain 5 whose configurations correspond to those of FIGS. 3*b*, 3*c*, 3*e*, 3*i* and 3*h*. This means that, looking at FIG. 4*b* from right to left, it is again the butt 25 of the punch 7 that, first lifted by the selector 9 (FIGS. 3*b* and 3*c*) and cooperating with the third actuating cams 41 (ascent 102), guides the needle 3 into the position of FIG. 3*i*.

Figure 4C:
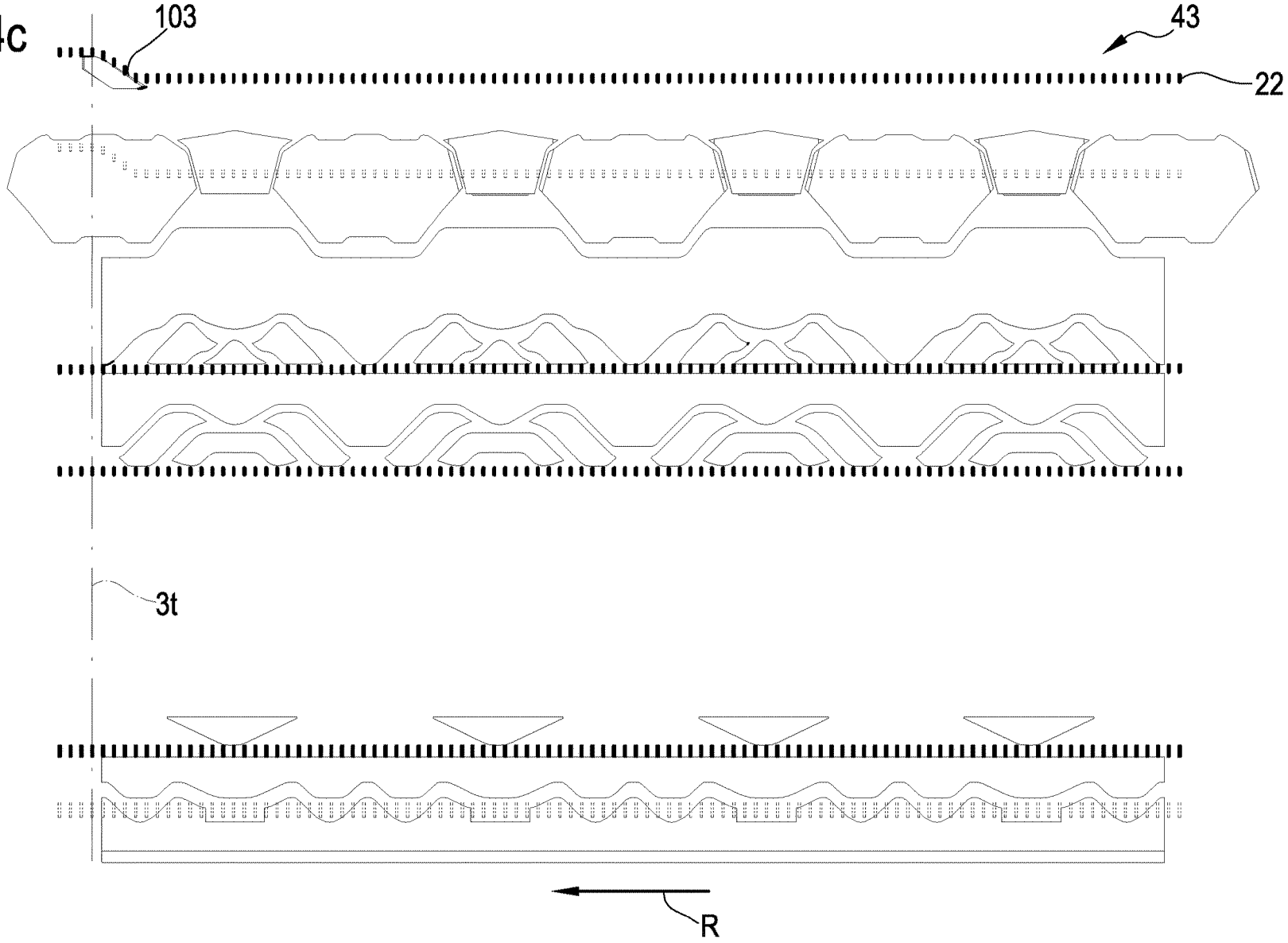

FIG. 4*c* shows the step with needle 3 at picking height. The vertical line 3*t* represents the position of the needle 3 and of the drive chain 5 whose configuration corresponds to those of FIG. 3*t*. This means that, looking at FIG. 4*c* from right to left, one of the fifth actuating cams 43 is guided into the respective operating position and the auxiliary butt 22 of the sub-needle 6 engages with an ascent 103 of said cam until the needle 3 is guided into the position of FIG. 3*t*, while the punch 7, the activating element 8 and the selector 9 remain in the lower axial position.

Figure 4D:
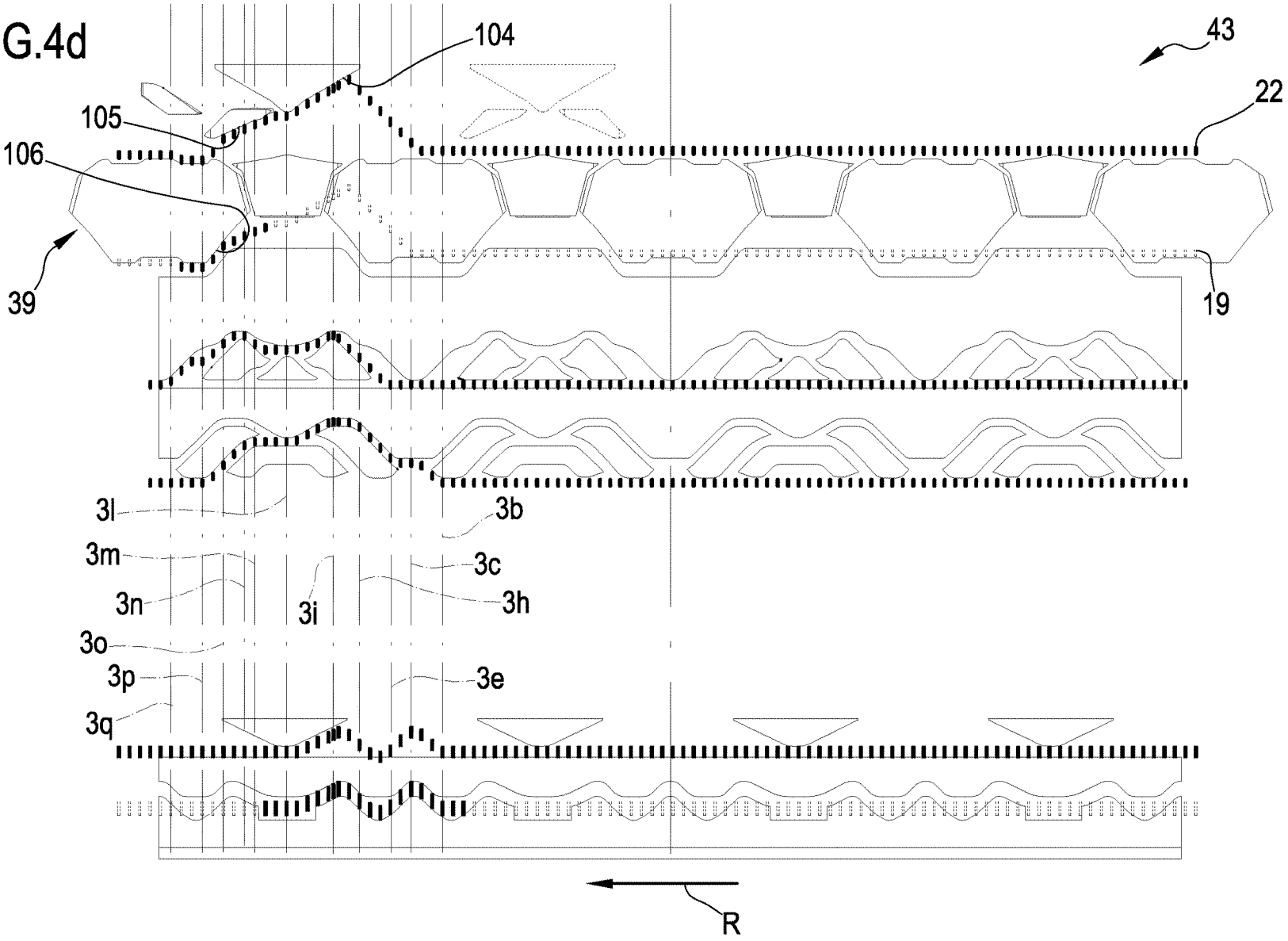

FIG. 4*d* shows the step of needle 3 lowering. The vertical lines 3*b*, 3*c*, 3*e*, 3*h*, 3*i*, 3*l*, 3*m*, 3*n*, 3*o*, 3*p*, 3*q* represent eleven positions of the needle 3 and of the drive chain 5 whose configurations correspond to those of FIGS. 3*b*, 3*c*, 3*e*, 3*h*, 3*i*, 3*l*, 3*m*, 3*n*, 3*o*, 3*p*, 3*q*. This means that, looking at FIG. 4*d* from right to left, some of the fifth actuating cams 43 are guided into the respective operating positions. The needle 3 and the sub-needle 6 are guided downwards first by the auxiliary butt 22, which cooperates with descents 104, 105 defined by the fifth actuating cams 43, operating, and then also by the radially moving butt 19 guided into its operating position (Figures and vertical lines 3*m*, 3*n*, 3*o*, 3*p*) and engaged into the descent 106.

What is described above is an example of the method for moving the needles of a circular knitting machine being the object of the present invention, which more generally comprises radially moving the butt 19 of the sub-needle 6 between the operating position, in which it is extracted so as to engage with respective first paths defined by the first actuating cams 39 and cause the activation of the needle 3 and the stitch formation, and the non-operating position (inactive needle), in which it is retracted so as not to engage with said first paths. The radial movement of the butt 19 of the sub-needle 6 is caused by the relative axial movement between the sub-needle 6 and the activating element 8 axially located below the sub-needle 6, and this relative axial movement is, at least in some steps, disconnected/independent from the axial movement of the punch 7 and also of the selector 9.

The invention achieves important advantages.

First of all, the invention allows to overcome the drawbacks of prior art.

In particular, the invention allows to:

produce circular machines that are very compact both in axial and radial direction;

produce circular machines that can manufacture tubular fabrics with small radial size, even below 100 mm;

produce circular machines with less stringent restraints on the needle movements to be obtained so as to manufacture even complex fabrics;

produce more compact circular machines than known machines, though allowing to obtain the same number of needle movements as bulkier machines or even more complex movements;

produce circular machines with a higher (even double) number of "feeds", i.e. yarn feeding points, with respect to the prior art and with the same cylinder diameter;

produce circular machines that can execute "intarsia" designs, i.e. motifs in color without floated yarns on the reverse;

produce circular machines that can manufacture three-dimensional textile articles without necessarily varying the knitting density and without requiring the addition of course portions with yarn shearing.

The invention claimed is:

1. A circular knitting machine, comprising:

a needle-holding cylinder having a plurality of longitudinal grooves arranged around a central axis of the needle-holding cylinder;

a plurality of needles, each being housed in a respective longitudinal groove;

actuating cams arranged around the needle-holding cylinder and movable with respect to said needle-holding cylinder around the central axis for causing or allowing movement of the needles along the longitudinal grooves so as to enable stitch formation by said needles;

a drive chain for each needle inserted into the respective longitudinal groove, located below the needle and operatively placed between the needle and said actuating cams;

wherein said drive chain comprises:

a sub-needle slidingly arranged in the respective longitudinal groove below the needle and having a butt, wherein the butt is radially movable between an operating position, in which it is extracted so as to engage with respective first paths defined by first actuating cams and cause activation of the needle and stitch formation by the needle, and a non-operating position, in which it is retracted so as not to engage with said first paths;

a selector at least partly slidingly arranged in the respective longitudinal groove below the sub-needle, having at least one respective butt radially movable between an operating position, in which it is extracted so as to engage with respective second paths defined by second actuating cams, and a non-operating position, in which it is retracted so as not to engage with said second paths;

at least one selecting device acting under control upon said selector for switching the latter into or retaining it in the operating position or the non-operating position;

a punch slidingly arranged in the respective longitudinal groove between the sub-needle and the selector, wherein a lower portion of the punch is engaged with the selector and an upper portion of the punch is engaged with the sub-needle, wherein the punch has a respective butt which can be engaged with respective third paths defined by third actuating cams;

wherein the drive chain comprises an activating element slidingly arranged in the respective longitudinal groove between the sub-needle and the selector, wherein the activating element can be longitudinally moved with respect to the punch and with respect to the sub-needle and can be operatively engaged with the sub-needle so as to switch the butt of the sub-needle into and retain it in the respective operating position.

2. The machine according to claim 1, wherein the sub-needle comprises a supporting portion carrying the respective butt, wherein said supporting portion is elastically movable between a first configuration, corresponding to the operating position of the butt, and a second configuration, corresponding to the non-operating position of the butt.

3. The machine according to claim 2, wherein the supporting portion is configured to exert an elastic restoring force upon the butt in the non-operating position of said butt.

4. The machine according to claim 2, wherein the supporting portion comprises an elastically flexible arm extending and projecting towards the activating element.

5. The machine according to claim 1, wherein the punch extends at least partly parallel and in a radially more inner position with respect to the activating element and to the sub-needle.

6. The machine according to claim 5, wherein the sub-needle comprises a supporting portion carrying the respective butt, wherein said supporting portion is elastically movable between a first configuration, corresponding to the operating position of the butt, and a second configuration, corresponding to the non-operating position of the butt, and wherein in the second configuration of the supporting portion, said supporting portion rests radially and at least partially against the punch.

7. The machine according to claim 2, wherein the activating element has an upper end with an inclined surface, wherein said inclined surface cooperates with a lower portion of the supporting portion, so as to switch the butt of the sub-needle into the respective operating position against the elastic force exerted by the supporting portion.

8. The machine according to claim 2, wherein the activating element has a seat located at said upper end and counter-shaped to the lower portion of the supporting portion, so as to receive at least part of said lower portion and retain the butt of the sub-needle in the respective operating position and/or to axially push against the ssub-needle.

9. The machine according to claim 1, wherein the activating element has a lower end which can be engaged against an abutting surface of the punch by means of a single-side axial rest.

10. The machine according to claim 1, wherein a lower end of the punch can be engaged against an abutting surface of the selector by means of a single-side axial rest.

11. The machine according to claim 1, wherein an upper end of the punch can be engaged against an abutting surface of the sub-needle by means of a single-side axial rest.

12. The machine according to claim 1, wherein the activating element has a respective butt which can be engaged with respective fourth paths defined by fourth actuating cams.

13. The machine according to claim 1, wherein the sub-needle has an auxiliary butt which can be engaged with respective fifth paths defined by fifth actuating cams.

14. The machine according to claim 1, wherein the selector has an auxiliary butt which can be engaged with respective sixth paths defined by sixth actuating cams.

15. The machine according to claim 1, wherein the selector comprises: an axially moving element slidingly arranged in the respective longitudinal groove and having said respective butt and auxiliary butt; an axially stationary element; wherein the axially stationary element is oscillating by effect of the selecting device and is operatively engaged to the axially moving element so as to radially move at least the respective butt between the operating and non-operating position.

16. The machine according to claim 1, wherein the drive chain is configured for decoupling an axial movement of the activating element from an axial movement of the punch.

17. A method for moving the needles of a circular knitting machine, wherein said machine is made in accordance with claim 1, comprising the steps of:

radially moving a butt of a sub-needle engaged with a respective needle, between an operating position, in which it is extracted so as to engage with respective first paths defined by first actuating cams and cause the activation of the needle and the stitch formation, and a non-operating position, in which it is retracted so as not to engage with said first paths;

wherein the radial movement of the butt of the sub-needle is caused by a relative axial movement between the sub-needle and the activating element axially located below the sub-needle;

wherein said relative axial movement is, at least in some steps, disconnected/independent from an axial movement of a punch and/or of a selector arranged under the needle and operatively activated by a selecting device acting under control upon said selector.

18. The method according to claim 17, wherein in said step of radially moving the butt of the sub-needle, said butt is switched into and retained in said operating position during needle descent.

19. The method according to claim 17, wherein a basically radial elastic force acts upon a supporting portion of the butt of the sub-needle so as to retain the butt in the non-operating position;

wherein during movement from the non-operating position to the operating position, an upper end of the activating element is inserted between a needle-holding cylinder and the supporting portion of the butt of the sub-needle and acts against the elastic force.

20. The method according to claim 19, wherein fifth actuating cams, into which an auxiliary butt of the sub-needle is engaged, guide said sub-needle axially downwards, while fourth actuating cams, into which a butt of the activating element is engaged, guide the activating element upwards until the upper end of the activating element is inserted between the needle-holding cylinder and the supporting portion of the butt of the sub-needle; or wherein the fifth actuating cams guide said sub-needle axially upwards, while the fourth actuating cams guide the activating element downwards until the upper end of the activating element is taken out from below the supporting portion of the butt of the sub-needle.

21. The method according to claim 17, wherein a maximum axial stroke of an axially moving element of the selector is smaller than a maximum axial stroke of the needle and/or sub-needle and/or than a maximum axial stroke of the activating element and/or than a maximum axial stroke of the punch.

* * * * *